United States Patent [19]

Abbott et al.

[11] 4,425,426

[45] Jan. 10, 1984

[54] RADIOGRAPHIC ELEMENTS EXHIBITING REDUCED CROSSOVER

[75] Inventors: Thomas I. Abbott, Rochester; Cynthia G. Jones, Bergen, both of N.Y.

[73] Assignee: Eastman Kodak Company, Rochester, N.Y.

[21] Appl. No.: 431,910

[22] Filed: Sep. 30, 1982

[51] Int. Cl.[3] ..... G03C 1/76

[52] U.S. Cl. ..... 430/502; 430/139; 430/567; 430/569; 430/570; 430/966

[58] Field of Search ..... 430/966, 139, 502, 567, 430/569, 570

[56] References Cited

U.S. PATENT DOCUMENTS

| | | | |
|---|---|---|---|
| 3,894,871 | 7/1975 | Land | 96/3 |
| 4,063,951 | 12/1977 | Bogg | 430/569 |
| 4,067,739 | 1/1978 | Lewis | 430/569 |
| 4,150,994 | 4/1979 | Maternaghan | 430/569 |
| 4,184,877 | 1/1980 | Maternaghan | 430/569 |
| 4,184,878 | 1/1980 | Maternaghan | 430/569 |
| 4,386,156 | 5/1983 | Mignot | 430/569 |

FOREIGN PATENT DOCUMENTS

| | | |
|---|---|---|
| 2905655 | 8/1979 | Fed. Rep. of Germany . |
| 2921077 | 11/1979 | Fed. Rep. of Germany . |
| 55-142329 | 11/1980 | Japan . |
| 1570581 | 7/1980 | United Kingdom . |

OTHER PUBLICATIONS

Zelikman and Levi *Making and Coating Photographic Emulsions,* Focal Press 1964, p. 223.

deCugnac and Chateau, "Evolution of the Morphology of Silver Bromide Crystals During Physical Ripening", *Science et Industries Photographiques,* vol. 33, No. 2 (1962), pp. 121–125.

Duffin, *Photographic Emulsion Chemistry,* Focal Press, 1966, pp. 66–72.

Trivelli and Smith "The Effect of Silver Iodide Upon the Structure of Bromo-Iodide Precipitation Series", *The Photographic Journal,* vol. LXXX, Jul. 1904, pp. 285–288.

Mees, *The Theory of the Photographic Process,* pp. 1062–1073.

*Primary Examiner*—Mary F. Downey

*Attorney, Agent, or Firm*—Carl O. Thomas

[57] ABSTRACT

Radiographic elements are disclosed comprised of first and second imaging portions separated by an interposed support capable of transmitting radiation to which the second imaging portion is responsive. At least the first imaging portion includes a silver halide emulsion in which thin tabular silver halide grains of intermediate aspect ratios are present. Spectral sensitizing dye is adsorbed to the surface of the tabular grains. Crossover can be improved in relation to the imaging characteristics.

15 Claims, No Drawings

RADIOGRAPHIC ELEMENTS EXHIBITING REDUCED CROSSOVER

FIELD OF THE INVENTION

This invention relates to radiographic elements. More specifically, this invention relates to radiographic elements containing at least two imaging portions separated by a support, at least one of the imaging portions including a silver halide emulsion.

BACKGROUND OF THE INVENTION

In silver halide photography one or more silver halide emulsion layers are usually coated on a single side of a support. An important exception is in medical radiography. To minimize X-ray dosage received by a patient silver halide emulsion layers are commonly coated on both sides of the support. Since silver halide emulsions are relatively inefficient absorbers of X-radiation, the radiographic element is positioned between intensifying screens that absorb X-radiation and emit light. Crossover exposure, which results in a reduction in image sharpness, occurs when light emitted by one screen passes through the adjacent emulsion layer and the support to imagewise expose the emulsion layer on the opposite side of the support. Loss of image sharpness is a result of light spreading in passing through the support. In radiographic applications in which the level of X-ray exposure can be increased wihout injury to the subject, as in nondestructive testing of materials, crossover can be avoided by coating on a single side of a support.

A great variety of regular and irregular grain shapes have been observes in silver halide photographic emulsions intended for black-and-white imaging applications generally and radiographic imaging applications specifically. Regular grains are often cubic or octahedral. Grain edges can exhibit rounding due to ripening effects, and in the presence of strong ripening agents, such as ammonia, the grains may even be spherical or near spherical thick platelets, as described, for example by Land U.S. Pat. No. 3,894,871 and Zelikman and Levi *Making and Coating Photographic Emulsions,* Focal Press, 1964, page 223. Rods and tabular grains in varied portions have been frequently observed mixed in among other grain shapes, particularly where the pAg (the negative logarithm of silver ion concentration) of the emulsions has varied during precipitation, as occurs, for example in single-jet precipitations.

Tabular silver bromide grains have been extensively studied, often in macro-sizes having no photographic utility. Tabular grains are herein defined as those having two substantially parallel crystal faces, each of which is substantially larger than any other single crystal face of the grain. The aspect ratio—that is, the ratio of diameter to thickness—of tabular grains is substantially greater than 1:1. High aspect ratio tabular grain silver bromide emulsions were reported by de Cugnac and Chateau, "Evolution of the Morphology of Silver Bromide Crystals During Physical Ripening", *Science et Industries Photographiques,* Vol. 33, No. 2 (1962), pp. 121–125.

From 1937 until the 1950's the Eastman Kodak Company sold a Duplitized® radiographic film product under the name No-Screen X-Ray Code 5133. The product contained as coatings on opposite major faces of a film support sulfur sensitized silver bromide emulsions. Since the emulsions were intended to be exposed by X-radiation, they were not spectrally sensitized. The tabular grains had an average aspect ratio in the intermediate range of from about 5 to 7:1 and were relatively thick. The tabular grains accounted for greater than 50% of the projected area while nontabular grains accounted for greater than 25% of the projected area. The emulsion having the highest average aspect ratio, chosen from several remakes, identified below as Control 1, had an average tabular grain diameter of 2.5 microns, an average tabular grain thickness of 0.36 micron, and an average aspect ratio of 7:1. In other remakes the emulsions contained thicker, smaller diameter tabular grains which were of lower average aspect ratio.

Although tabular grain silver bromoiodide emulsions are known in the art, none exhibit a high average aspect ratio. A discussion of tabular silver bromoiodide grains appears in Duffin, *Photographic Emulsion Chemistry,* Focal Press, 1966, pp. 66–72, and Trivelli and Smith, "The Effect of Silver Iodide Upon the Structure of Bromo-Iodide Precipitation Series", *The Photographic Journal,* Vol. LXXX, July 1940, pp. 285–288. Trivelli and Smith observed a pronounced reduction in both grain size and aspect ratio with the introduction of iodide. Gutoff, "Nucleation and Growth Rates During the Precipitation of Silver Halide Photographic Emulsions", *Photographic Sciences and Engineering,* Vol. 14, No. 4, July-August 1970, pp. 248–257, reports preparing silver bromide and silver bromoiodide emulsions of the type prepared by single-jet precipitations using a continuous precipitation apparatus.

Bogg, Lewis, and Maternaghan have recently published procedures for preparing emulsions in which a major proportion of the silver halide is present in the form of tabular grains. Bogg U.S. Pat. No. 4,063,951 teaches forming silver halide crystals of tabular habit bounded by {100} cubic faces and having an aspect ratio (based on edge length) of from 1.5 to 7:1. The tabular grains exhibit square and rectangular major surfaces characteristic of {100} crystal faces. In the example reported the average edge length of the grains was 0.93 micron and the average aspect ratio 2:1. Thus the average grain thickness was 0.46 micron, indicating thick tabular grains were produced. Lewis U.S. Pat. No. 4,067,739 teaches the preparation of silver halide emulsions wherein most of the crystals are of the twinned octahedral type by forming seed crystals, causing the seed crystals to increase in size by Ostwald ripening in the presence of a silver halide solvent, and completing grain growth without renucleation or Ostwalt ripening while controlling pBr (the negative logarithm of bromide ion concentration). Maternaghan U.S. Pat. Nos. 4,150,994, 4,184,877, and 4,184,878, U.K. Pat. No. 1,570,581, and German OLS publication Nos. 2,905,655 and 2,921,077 teach the formation of silver halide grains of flat twinned octahedral configuration by employing seed crystals which are at least 90 mole percent iodide. (Except as otherwise indicated, all references to halide percentages are based on silver present in the corresponding emulsion, grain, or grain region being discussed.) Lewis and Maternaghan report increased covering power. Maternaghan states that the emulsions are useful in camera films, both black-and-white and color. It appears from repeating examples and viewing the photomicrographics published that average tabular grain thicknesses were greater than 0.40 micron. Japanese patent Kokai No. 142,329, published Nov. 6, 1980, appears to be essentially cumulative with Maternaghan, but is not restricted to the use of silver iodide seed grains. Thus, the patents discussed above in this paragraph are viewed as teaching the preparation of silver halide emulsions containing relatively thick tabular grains of intermediate average aspect ratios.

Wilgus and Haefner U.S. Ser. No. 429,420, filed concurrently herewith and commonly assigned, titled HIGH ASPECT RATIO SILVER BROMOIODIDE EMULSIONS AND PROCESSES FOR THEIR PREPARATION, which is a continuation-in-part of U.S. Ser. No. 320,905, filed Nov. 12, 1981, now abandoned, more fully discussed below, discloses high aspect ratio silver bromoiodide emulsions and a process for their preparation.

Kofron et al U.S. Ser. No. 429,407, filed concurrently herewith and commonly assigned, titled SENSITIZED HIGH ASPECT RATIO SILVER HALIDE EMULSIONS AND PHOTOGRAPHIC ELEMENTS, which is a continuation-in-part of U.S. Ser. No. 320,904, filed Nov. 12, 1981, now abandoned, more fully discussed below, discloses chemically and spectrally sensitized high aspect ratio tabular grain silver halide emulsions and photographic elements incorporating these emulsions.

Daubendiek and Strong U.S. Ser. No. 429,587, filed concurrently herewith and commonly assigned, titled AN IMPROVED PROCESS FOR THE PREPARATION OF HIGH ASPECT RATIO SILVER BROMOIODIDE EMULSIONS, which is a continuation-in-part of U.S. Ser. No. 320,906, filed Nov. 12, 1981, now abandoned, more fully discussed below, discloses an improvement on the processes of Maternaghan whereby relatively thin high aspect ratio tabular grain silver bromoiodide emulsions can be prepared.

Wey U.S. Ser. No. 429,403, filed concurrently herewith and commonly assigned, titled IMPROVED DOUBLE-JET PRECIPITATION PROCESS AND PRODUCTS THEREOF, which is a continuation-in-part of U.S. Ser. No. 320,908, filed Nov. 12, 1981, now abandoned, discloses a process of preparing tabular silver chloride grains which are substantially internally free of both silver bromide and silver iodide. The emulsions have an average aspect ratio of greater than 8:1.

Solberg, Piggin, and Wilgus U.S. Ser. No. 431,913, filed concurrently herewith and commonly assigned, titled RADIATION-SENSITIVE SILVER BROMOIODIDE EMULSIONS, PHOTOGRAPHIC ELEMENTS, AND PROCESSES FOR THEIR USE, which is a continuation-in-part of U.S. Ser. No. 320,909, filed Nov. 12, 1980, now abandoned discloses a high aspect ratio tabular grain silver bromoiodide emulsions wherein a higher concentration of iodide is present in an annular region than in a central region of the tabular grains.

Dickerson U.S. Ser. No. 430,574, filed concurrently herewith and commonly assigned, titled FOREHARDENED PHOTOGRAPHIC ELEMENTS AND PROCESSES FOR THEIR USE, which is a continuation-in-part of U.S. Ser. No. 320,910, filed Nov. 12, 1981, now abandoned discloses producing silver images of high covering power by employing photographic elements containing forehardened thin tabular grain silver halide emulsions.

Mignot U.S. Ser. No. 320,912, filed concurrently herewith and commonly assigned, titled SILVER BROMIDE EMULSIONS OF NARROW GRAIN SIZE DISTRIBUTION AND PROCESSES FOR THEIR PREPARATION discloses high aspect ratio tabular grain silver bromide emulsions wherein the tabular grains are square or rectangular in projected area.

Jones and Hill U.S. Ser. No. 430,092, filed concurrently herewith and commonly assigned, titled PHOTOGRAPHIC IMAGE TRANSFER FILM UNIT, which is a continuation-in-part of U.S. Ser. No. 320,911, filed Nov. 12, 1981, now abandoned, discloses image transfer film units containing tabular grain silver halide emulsions.

Evans et al U.S. Ser. No. 431,912, filed concurrently herewith and commonly assigned, titled DIRECT REVERSAL EMULSIONS AND PHOTOGRAPHIC ELEMENTS USEFUL IN IMAGE TRANSFER FILM UNITS which is a continuation-in-part of U.S. Ser. No. 320,891, filed Nov. 12, 1981, now abandoned, discloses image transfer film units containing tabular grain core-shell silver halide emulsions.

Maskasky U.S. Ser. No. 431,455, filed concurrently herewith and commonly assigned, titled SILVER CHLORIDE EMULSIONS OF MODIFIED CRYSTAL HABIT AND PROCESSES FOR THEIR PREPARATION, which is a continuation-in-part of U.S. Ser. No. 320,898, filed Nov. 12, 1981, now abandoned, discloses a process of preparing tabular grains having opposed major crystal faces lying in {111} crystal planes and, in one preferred form, at least one peripheral edge lying perpendicular to a <211> crystallographic vector in the plane of one of the major surfaces. Thus, the crystal edges obtained are crystallographically offset 30° C. as compared to those of Wey. Maskasky requires that the novel tabular grains be predominantly (that is, at least 50 mole percent) chloride.

Wey and Wilgus U.S. Ser. No. 431,854, filed concurrently herewith and commonly assigned, titled NOVEL SILVER CHLOROBROMIDE EMULSIONS AND PROCESSES FOR THEIR PREPARATION which is a continuation-in-part of U.S. Ser. No. 320,899, filed Nov. 12, 1981, now abandoned, discloses tabular grain silver chlorobromide emulsions in which the molar ratio of chloride to bromide ranges up to 2:3.

Maskasky U.S. Ser. No. 431,855, filed concurrently herewith and commonly assigned, titled CONTROLLED SITE EPITAXIAL SENSITIZATION, which is a continuation-in-part of U.S. Ser. No. 320,920, filed Nov. 12, 1981, now abandoned discloses high aspect ratio tabular grain emulsions wherein silver salt is epitaxially located on and substantially confined to selected surface sites of the tabular silver halide grains.

Abbott and Jones U.S. Ser. No. 430,222, filed concurrently herewith and commonly assigned, titled RADIOGRAPHIC ELEMENTS EXHIBITING REDUCED CROSSOVER, which is a continuation-in-part of U.S. Ser. No. 320,907, filed Nov. 12, 1981, now abandoned, discloses radiographic elements comprised of first and second imging portions separated by an interposed support capable of transmitting radiation to which the second imaging portion is responsive. At least the first imaging portion includes a silver halide emulsion in which high aspect ratio tabular silver halide grains are present. Spectral sensitizing dye is adsorbed to the surface of the tabular grains. Crossover is improved in relation to the imaging characteristics of the radiographic element.

SUMMARY OF THE INVENTION

In one aspect this invention is directed to a radiographic element comprised of first and second imaging means. At least the first imaging means includes a silver halide emulsion comprised of a dispersing medium and radiation-sensitive silver halide grains. A support is interposed between the imaging means capable of transmitting radiation to which the second imaging means is responsive. The radiographic element is characterized by the first imaging means containing tabular silver halide grains having a thickness of less than 0.2 micron and an average aspect ratio in the range of from 5:1 to 8:1 accounting for at least 50 percent of the total projected area of the silver halide grains present in the silver halide emulsion. Spectral sensitizing dye is adsorbed to the surface of the tabular silver halide grains in an amount sufficient to substantially optimally sensitize said tabular silver halide grains.

It is an object of this invention to provide a radiographic element exhibiting unexpectedly reduced crossover of exposing radiation and therefore less reduction of sharpness attributable to crossover, taking other photographic characteristics into account. More specifically, it is an object of this invention to provide a radiographic element having at least one silver halide emulsion layer which, at a selected silver coverage (based on the weight of silver per unit area of the emulsion layer) and at a comparable photographic speed, permits less crossover of exposing radiation.

DESCRIPTION OF PREFERRED EMBODIMENTS

The present invention is broadly applicable to any radiographic element having separate imaging units, at least one of which is comprised of a silver halide emulsion, the units being separated by a support which is capable of transmitting to one of the imaging units radiation penetrating the silver halide emulsion of the other unit. In a preferred configuration the radiographic elements have imaging units coated on each of two opposed major surfaces of a transmitting support, such as a film support. Alternate arrangements are possible. Instead of coating the imaging units on opposite sides of the same support, they can be coated on separate supports, and the resulting structures stacked so that one support or both supports separate the imaging units.

The imaging units can take the form of any conventional radiographic imaging layer or combination of layers, provided at least one layer is comprised of a relatively thin, intermediate aspect ratio tabular grain silver halide emulsion, as more specifically described below. In a preferred form of the invention the imaging units are both silver halide emulsion layer units. While it is specifically contemplated that the imaging units can each employ differing radiation-sensitive silver halide emulsions, in a specifically preferred form of the invention both of the imaging units are comprised of thin, intermediate aspect ratio tabular grain silver halide emulsions. It is generally preferred to employ two identical imaging units separated by an interposed support. Emulsions other than the required thin, intermediate aspect ratio tabular grain emulsion can take any convenient conventional form. Various conventional emulsions are illustrated by *Research Disclosure,* Vol. 176, December 1978, Item 17643, Paragraph I, Emulsion preparation and types, here incorporated by reference. (*Research Disclosure* and its predecessor, *Product Licensing Index,* are publications of Industrial Opportunities Ltd.; Homewell, Havant; Hampshire, P09 1EF, United Kingdom.)

a. Thin, intermediate aspect ratio tabular grain emulsions and their preparation The thin, intermediate aspect ratio tabular grain silver halide emulsions are comprised of a dispersing medium and spectrally sensitized tabular silver halide grains. As applied to the silver halide emulsions the term "thin, intermediate aspect ratio" is herein defined as requiring that the tabular silver halide grains having a thickness of less than 0.2 micron and an average aspect ratio in the range of 5:1 to 8:1 account for at least 50 percent of the total projected area of the silver halide grains. In a preferred form of the invention these silver halide grains satisfying the above thickness and aspect ratio criteria account for at least 70 percent and optimally at least 90 percent of the total projected area of the silver halide grains.

The grain characteristics described above of the silver halide emulsions of this invention can be readily ascertained by procedures well known to those skilled in the art. As employed herein the term "aspect ratio" refers to the ratio of the diameter of the grain to its thickness. The "diameter" of the grain is in turn defined as the diameter of a circle having an area equal to the projected area of the grain as viewed in a photomicrograph or an electron micrograph of an emulsion sample. From shadowed electron micrographs of emulsion samples it is possible to determine the thickness and diameter of each rain and to identify those tabular grains having a thickness of less than 0.2 micron—i.e., the thin tabular grains. From this the aspect ratio of each such thin tabular grain can be calculated, and the aspect ratios of all the thin tabular grains in the sample can be averaged to obtain their average aspect ratio. By this definition the average aspect ratio is the average of individual thin tabular grain aspect ratios. In practice it is usually simpler to obtain an average thickness and an average diameter of the thin tabular grains having a thickness of less than 0.2 micron and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ. The projected areas of the thin tabular silver halide grains can be summed, the projected areas of the remaining silver halide grains in the photomicrograph can be summed separately, and from the two sums the percentage of the total projected area of the silver halide grains provided by the thin tabular grains can be calculated.

In the above determinations a reference tabular grain thickness of less than 0.2 micron was chosen to distinguish the uniquely thin tabular grains herein contemplated from thicker tabular grains which provide inferior radiographic properties. At lower diameters it is not always possible to distinguish tabular and nontabular grains in micrographs. The tabular grains for purposes of this disclosure are those silver halide grains which are less than 0.2 micron in thickness and appear tabular at 2,500 times magnification. The term "projected area" is used in the same sense as the term "projection area" and "projective area" commonly employed in the art; see, for example, James and Higgins, *Fundamentals of Photographic Theory,* Morgan and Morgan, New York, p. 15.

The tabular grains can be of any silver halide crystal composition known to be useful in photography. In a preferred form offering the broadest range of observed advantages the present invention employs thin, intermediate aspect ratio silver bromoiodide emulsions. High aspect ratio silver bromoiodide emulsions and their preparation is the subject of Wilgus and Haefner, cited above and here incorporated by reference. Generally similar procedures can be used to form thin, intermediate aspect ratio tabular grain silver bromoiodide emulsions for use in the radiographic elements of this invention. Maintaining intermediate, as opposed to high, aspect ratio can be achieved merely by terminating precipitation earlier although other procedures, such as increasing grain thickness sufficiently to reduce aspect ratios and other techniques employed in the examples, can be employed alternatively or in combination. Obtaining thin grains at the outset of precipitation, as described below, will result in the intermediate aspect ratio tabular grain emulsions having thin tabular grains.

Thin, intermediate aspect ratio tabular grain silver bromoiodide emulsions can be prepared by a precipitation process similar to that which forms a part of the Wilgus and Haefner invention as follows: Into a conventional reaction vessel for silver halide precipitation equipped with an efficient stirring mechanism is introduced a dispersing medium. Typically the dispersing medium initially introduced into the reaction vessel is at least about 10 percent, preferably 20 to 80 percent, by weight based on total weight of the dispersing medium present in the silver bromoiodide emulsion at the conclusion of grain precipitation. Since dispersing medium can be removed from the reaction vessel by ultrafiltration during silver bromoiodide grain precipitation, as taught by Mignot U.S. Pat. No. 4,334,012 here incorporated by reference, it is appreciated that the volume of dispersing medium initially present in the reaction vessel can equal or even exceed the volume of the silver bromoiodide emulsion present in the reaction vessel at the conclusion of grain precipitation. The dispersing medium initially introduced into the reaction vessel is preferably water or a dispersion of peptizer in water, optionally containing other ingredients, such as one or more silver halide ripening agents and/or metal dopants, more specifically described below. Where a peptizer is initially present, it is preferably employed in a concentration of at least 10 percent, most preferably at least 20 percent, of the total peptizer present at the completion of silver bromoidodide precipitation. Additional dispersing medium is added to the reaction vessel with the silver and halide salts and can also be introduced through a separate jet. It is common practice to adjust the proportion of dispersing medium, particularly to increase the proportion of peptizer, after the completion of the salt introductions.

A minor portion, typically less than 10 percent, of the bromide salt employed in forming the silver bromoiodide grains is initially present in the reaction vessel to adjust the bromide ion concentration of the dispersing medium at the outset of silver bromoiodide precipitation. Also, the dispersing medium in the reaction vessel is initially substantially free of iodide ions, since the presence of iodide ions prior to concurrent introduction of silver and bromide salts favors the formation of thick and nontabular grains. As employed herein, the term "substantially free of iodide ions" as applied to the contents of the reaction vessel means that there are insufficient iodide ions present as compared to bromide ions to precipitate as a separate silver iodide phase. It is preferred to maintain the iodide concentration in the reaction vessel prior to silver salt introduction at less than 0.5 mole percent of the total halide ion concentration present.

If the pBr of the dispersing medium is initially too high, the tabular silver bromoiodide grains produced will be comparatively thick and therefore of low aspect ratios. It is preferred to maintain the pBr of the reaction vessel initially at or below 1.5. On the other hand, if the pBr is too low, the formation of nontabular silver bromoiodide grains is favored. Therefore, it is contemplated to maintain the pBr of the reaction vessel at or above 0.6, preferably above 1.1. (As herein employed, pBr is defined as the negative logarithm of bromide ion concentration. Both pH and pAg are similarly defined for hydrogen and silver ion concentrations, respectively.)

During precipitation silver, bromide, and iodide salts are added to the reaction vessel by techniques well known in the precipitation of silver bromoiodide grains. Typically an aqueous silver salt solution of a soluble silver salt, such as silver nitrate, is introduced into the reaction vessel concurrently with the introduction of the bromide and iodide salts. The bromide and iodide salts are also typically introduced as aqueous salt solutions, such as aqueous solutions of one or more soluble ammonium, alkali metal (e.g., sodium or potassium), or alkaline earth metal (e.g., magnesium or calcium) halide salts. The silver salt is at least initially introduced into the reaction vessel separately from the iodide salt. The iodide and bromide salts are added to the reaction vessel separately or as a mixture.

With the introduction of silver salt into the reaction vessel the nucleation stage of grain formation is initiated. A population of grain nuclei is formed which is capable of serving as precipitation sites for silver bromide and silver iodide as the introduction of silver, bromide, and iodide salts continues. The precipitation of silver bromide and silver iodide onto existing grain nuclei constitutes the growth stage of grain formation. The aspect ratios of the tabular grains formed according to this invention are less affected by iodide and bromide concentrations during the growth stage than during the nucleation stage. It is therefore possible during the growth stage to increase the permissible latitude of pBr during concurrent introduction of silver, bromide, and iodide salts above 0.6, preferably in the range of from about 0.6 to 2.2, most preferably from about 0.8 to about 1.5. It is, of course, possible and, in fact, preferred to maintain the pBr within the reaction vessel throughout silver and halide salt introduction within the initial limits, described above prior to silver salt introduction. This is particularly preferred where a substantial rate of grain nuclei formation continues throughout the introduction of silver, bromide, and iodide salts, such as in the preparation of highly polydispersed emulsions. Raising pBr values above 2.2 during tabular grain growth results in thickening of the grains, but can be tolerated in many instances while still realizing thin, intermediate aspect ratio silver bromoiodide grains.

As an alternative to the introduction of silver, bromide, and iodide salts as aqueous solutions, it is specifically contemplated to introduce the silver, bromide, and iodide salts, initially or in the growth stage, in the form of fine silver halide grains suspended in dispersing medium. The grains are sized so that they are readily Ostwald ripened onto larger grain nuclei, if any are present, once introduced into the reaction vessel. The maximum useful grain sizes will depend on the specific conditions within the reaction vessel, such as temperature and the presence of solubilizing and ripening agents. Silver bromide, silver iodide, and/or silver bromoiodide grains can be introduced. (Since bromide and/or iodide are precipitated in preference to chloride, it is also possible to employ silver chlorobromide and silver chlorobromoiodide grains.) The silver halide grains are preferably very fine—e.g., less than 0.1 micron in mean diameter.

Subject to the pBr requirements set forth above, the concentrations and rates of silver, bromide, and iodide salt introductions can take any convenient conventional form. The silver and halide salts are preferably introduced in concentrations of from 0.1 to 5 moles per liter, although broader conventional concentration ranges, such as from 0.01 mole per liter to saturation, for example, are contemplated. Specifically preferred precipitation techniques are those which achieve shortened precipitation times by increasing the rate of silver and halide salt introduction. The rate of silver and halide salt introduction can be increased either by increasing the rate at which the dispersing medium and the silver and halide salts are introduced or by increasing the concentrations of the silver and halide salts within the dispersing medium being introduced. It is specifically preferred to increase the rate of silver and halide salt introduction, but to maintain the rate of introduction below the threshold level at which the formation of new grain nuclei is favored—i.e., to avoid renucleation, as taught by Irie U.S. Pat. No. 3,650,757, Kurz U.S. Pat. No. 3,672,900, Saito U.S. Pat. No. 4,242,445, Wilgus German OLS No. 2,107,118, Teitscheid et al European Patent Application No. 80102242, and Wey "Growth Mechanism of AgBr Crystals in Gelatin Solution", *Photographic Science and Engineering,* Vol. 21, No. 1, January/February 1977, p. 14, et. seq. By avoiding the formation of additional grain nuclei after passing into the growth stage of precipitation, relatively monodispersed thin tabular silver bromoiodide grain populations can be obtained. Emulsions having coefficients of variation of less than about 30 percent can be prepared. (As employed herein the coefficient of variation is defined as 100 times the standard deviation of the grain diameter divided by the average grain diameter.) By intentionaly favoring renucleation during the growth stage of precipitation, it is of course, possible to produce polydispersed emulsions of substantially higher coefficients of variation.

The concentration of iodide in the silver bromoiodide emulsions of this invention can be controlled by the introduction of iodide salts. Any conventional iodide concentration can be employed. Even very small amounts of iodide—e.g., as low as 0.05 mole percent—are recognized in the art to be beneficial. (Except as otherwise indicated, all references to halide percentages are based on silver present in the corresponding emulsion, grain, or grain region being discussed; e.g., a grain consisting of silver bromoidide containing 40 mole percent iodide also contains 60 mole percent bromide.) In one preferred form the emulsions of the present invention incorporate at least about 0.1 mole percent iodide. Silver iodide can be incorporated into the tabular silver bromoiodide grains up to its solubility limit in silver bromide at the temperature of grain formation. Thus, silver iodide concentrations of up to about 40 mole percent in the tabular silver bromoiodide grains can be achieved at precipitation temperatures of 90° C. In practice precipitation temperatures can range down to near ambient room temperatures—e.g., about 30° C. It is generally preferred that precipitation be undertaken at temperatures in the range of from 40° to 80° C. While for most photographic applications it is preferred to limit maximum iodide concentrations to about 20 mole percent, with optimum iodide concentrations being up to about 15 mole percent and such iodide concentrations can be employed in the practice of this invention, it is typically preferred in radiographic elements to limit iodide concentrations to up to 6 mole percent.

The relative proportion of iodide and bromide salts introduced into the reaction vessel during precipitation can be maintained in a fixed ratio to form a substantially uniform iodide profile in the tabular silver bromoiodide grains or varied to achieve differing photographic effects. Solberg et al, cited above, has recognized that advantages in photographic speed and/or granularity can result from increasing the proportion of iodide in laterally displaced, typically annular regions, of high aspect ratio tabular grain silver bromoiodide emulsions as compared to central regions of the tabular grains. Solberg et al teaches iodide concentrations in the central regions of the tabular grains of from 0 to 5 mole percent, with at least one mole percent higher iodide concentrations in the laterally surrounding annular regions up to the solubility limit of silver iodide in silver bromide, preferably up to about 20 mole percent and optimally up to about 15 mole percent. The teachings of Solberg et al are directly applicable to this invention. The tabular silver bromoidide grains of the present invention can exhibit substantially uniform or graded iodide concentration profiles, and the gradation can be controlled, as desired, to favor higher iodide concentrations internally or at or near the surfaces of the tabular silver bromoiodide grains.

Although the preparation of the thin, intermediate aspect ratio tabular grain silver bromoiodide emulsions has been described by reference to the process of Wilgus and Haefner, which produces neutral or nonammoniacal emulsions, the emulsions of the present invention and their utility are not limited by any particular process for their preparation. A process of preparing high aspect ratio tabular grain silver bromoiodide emulsions discovered subsequent to that of Wilgus and Haefner is described by Daubendiek and Strong, cited above and here incorporated by reference. Daubendiek and Strong teaches an improvement over the processes of Maternaghan, cited above, wherein in a preferred form the silver iodide concentration in the reaction vessel is reduced below 0.05 mole per liter and the maximum size of the silver iodide grains initially present in the reaction vessel is reduced below 0.05 micron. Merely by terminating precipitation sooner, thin, intermediate aspect ratio tabular grain silver bromoiodide emulsions as employed in the radiographic elements of this invention can be produced.

Thin, intermediate aspect ratio tabular grain silver bromide emulsions lacking iodide can be prepared by the process described above similar to the process of Wilgus and Haefner further modified to exclude iodide. Generally the exclusion of iodide results in the formation of thinner tabular grains when precipitation conditions are otherwise similar to those described above for precipitating tabular silver bromoiodide grains. Thin, intermediate aspect ratio silver bromide emulsions containing square and rectangular grains can be prepared similarly as taught by Mignot U.S. Ser. No. 320,912, cited above. In this process cubic seed grains having an edge length of less than 0.15 micron are employed. While maintaining the pAg of the seed grain emulsion in the range of from 5.0 to 8.0, the emulsion is ripened in the substantial absence of nonhalide silver ion complexing agents to produce tabular silver bromide grains having the desired intermediate average aspect ratio. Still other preparations of thin, intermediate aspect ratio tabular grain silver bromide emulsions lacking iodide are illustrated in the examples.

To illustrate other thin, intermediate aspect ratio tabular grain silver halide emulsions which can be prepared merely by terminating precipitation when the desired intermediate aspect ratios are achieved, attention is directed to the following:

Maskasky U.S. Ser. No. 320,898, cited above and here incorporated by reference, discloses a process of preparing tabular grains of at least 50 mole percent chloride having opposed crystal faces lying in {111} crystal planes and at least one peripheral edge lying parallel to a <211> crystallographic vector in the plane of one of the major surfaces. Such tabular grain emulsions can be prepared by reacting aqueous silver and chloride-containing halide salt solutions in the presence of a crystal habit modifying amount of an amino-substituted azaindene and a peptizer having a thioether linkage.

Wey and Wilgus, cited above and here incorporated by reference, discloses tabular grain emulsions wherein the silver halide grains contain silver chloride and silver bromide in at least annular grain regions and preferably throughout. The tabular grain regions containing silver, chloride, and bromide are formed by maintaining a molar ratio of chloride and bromide ions of from 1.6 to about 260:1 and the total concentration of halide ions in the reaction vessel in the range of from 0.10 to 0.90 normal during introduction of silver, chloride, bromide, and, optionally, iodide salts into the reaction vessel. The molar ratio of silver chloride to silver bromide in the tabular grains can range from 1:99 to 2:3.

The thin tabular grains can have average diameters of up to 1.6 microns. However, smaller average diameters are contemplated, and are limited only by the minimum average tabular grain thicknesses attainable. Typically the tabular grains have an average thickness of at least 0.03 micron, although even thinner tabular grains can in principle be employed—e.g., as low as 0.01 micron, depending upon halide content. Therefore minimum diameters of these grains, assuming a 5:1 average aspect ratio, is typically at least 0.15 micron.

Modifying compounds can be present during tabular grain precipitation. Such compounds can be initially in the reaction vessel or can be added along with one or more of the salts according to conventional procedures. Modifying compounds, such as compounds of copper, thallium, lead, bismuth, cadmium, zinc, middle chalcogens (i.e., sulfur, selenium and tellurium), gold, and Group VIII noble metals, can be present during silver halide precipitation, as illustrated by Arnold et al U.S. Pat. No. 1,195,432, Hochstetter U.S. Pat. No. 1,951,933, Trivelli et al U.S. Pat. No. 2,448,060, Overman U.S. Pat. No. 2,628,167, Mueller et al U.S. Pat. No. 2,950,972, Sidebotham U.S. Pat. No. 3,488,709, Rosecrants et al U.S. Pat. No. 3,737,313, Berry et al U.S. Pat. No. 3,772,031, Atwell U.S. Pat. No. 4,269,927, and *Research Disclosure,* Vol. 134, June 1975, Item 13452. The tabular grain emulsions can be internally reduction sensitized during precipitation, as illustrated by Moisar et al, *Journal of Photographic Science,* Vol. 25, 1977, pp. 19–27.

The individual silver and halide salts can be added to the reaction vessel through surface or subsurface delivery tubes by gravity feed or by delivery apparatus for maintaining control of the rate of delivery and the pH, pBr, and/or pAg of the reaction vessel contents, as illustrated by Culhane et al U.S. Pat. No. 3,821,002, Oliver U.S. Pat. No. 3,031,304 and Claes et al, *Photographische Korrespondenz,* Band 102, Number 10, 1967, p. 162. In order to obtain rapid distribution of the reactants within the reaction vessel, specially constructed mixing devices can be employed, as illustrated by Audran U.S. Pat. No. 2,996,287, McCrossen et al U.S. Pat. No. 3,342,605, Frame et al U.S. Pat. No. 3,415,650, Porter et al U.S. Pat. No. 3,785,777, Finnicum et al U.S. Pat. No. 4,147,551, Verhille et al U.S. Pat. No. 4,171,224, Calamur U.K. patent application No. 2,022,431A, Saito et al German OLS Nos. 2,555,364 and 2,556,885, and *Research Disclosure,* Volume 166, February 1978, Item 16662.

In forming the tabular grain emulsions peptizer concentrations of from 0.2 to about 10 percent by weight, based on the total weight of emulsion components in the reaction vessel, can be employed; it is preferred to keep the concentration of the peptizer in the reaction vessel prior to and during silver bromoiodide formation below about 6 percent by weight, based on the total weight. It is common practice to maintain the concentration of the peptizer in the reaction vessel in the range of below about 6 percent, based on the total weight, prior to and during silver halide formation and to adjust the emulsion vehicle concentration upwardly for optimum coating characteristics by delayed, supplemental vehicle additions. It is contemplated that the emulsion as initially formed will contain from about 5 to 50 grams of peptizer per mole of silver halide, preferably about 10 to 30 grams of peptizer per mole of silver halide. Additionally vehicle can be added later to bring the concentration up to as high as 1000 grams per mole of silver halide. Preferably the concentration of vehicle in the finished emulsion is above 50 grams per mole of silver halide. When coated and dried in forming a photographic element the vehicle preferably forms about 30 to 70 percent by weight of the emulsion layer.

Vehicles (which include both binders and peptizers) can be chosen from among those conventionally employed in silver halide emulsions. Preferred peptizers are hydrophilic colloids, which can be employed alone or in combination with hydrophobic materials. Suitable hydrophilic materials include substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, agar-agar, arrowroot, albumin and the like as described in Yutzy et al U.S. Pat. Nos. 2,614,928 and '929, Lowe et al U.S. Pat. Nos. 2,691,582, 2,614,930, '931, 2,327,808 and 2,448,534, Gates et al U.S. Pat. Nos. 2,787,545 and 2,956,880, Himmelmann et al U.S. Pat. No. 3,061,436, Farrell et al U.S. Pat. No. 2,816,027, Ryan U.S. Pat. Nos. 3,132,945, 3,138,461 and 3,186,846, Dersch et al U.K. Pat. No. 1,167,159 and U.S. Pat. Nos. 2,960,405 and 3,436,220, Geary U.S. Pat. No. 3,486,896, Gazzard U.K. Pat. No. 793,549, Gates et al U.S. Pat. Nos. 2,992,213, 3,157,506, 3,184,312 and 3,539,353, Miller et al U.S. Pat. No. 3,227,571, Boyer et al U.S. Pat. No. 3,532,502, Malan U.S. Pat. No. 3,551,151, Lohmer et al U.S. Pat. No. 4,018,609, Luciani et al U.K. Pat. No. 1,186,790, Hori et al U.K. Pat. No. 1,489,080 and Belgian Pat. No. 856,631, U.K. Pat. No. 1,490,644, U.K. Pat. No. 1,483,551, Arase et al U.K. Pat. No. 1,459,906, Salo U.S. Pat. Nos. 2,110,491 and 2,311,086, Fallesen U.S. Pat. No. 2,343,650, Yutzy U.S. Pat. No. 2,322,085, Lowe U.S. Pat. No. 2,563,791, Talbot et al U.S. Pat. No. 2,725,293, Hilborn U.S. Pat. No. 2,748,022, DePauw et al U.S. Pat. No. 2,956,883, Ritchie U.K. Pat. No. 2,095, DeStubner U.S. Pat. No. 1,752,069, Sheppard et al U.S. Pat. No. 2,127,573, Lierg U.S. Pat. No. 2,256,720, Gaspar U.S. Pat. No. 2,361,936, Farmer U.K. Pat. No. 15,727, Stevens U.K. Pat. No. 1,062,116 and Yamamoto et al U.S. Pat. No. 3,923,517.

Other materials commonly employed in combination with hydrophilic colloid peptizers as vehicles (including vehicle extenders—e.g., materials in the form of latices) include synthetic polymeric peptizers, carriers and/or binders such as poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidiones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe U.S. Pat. Nos. 2,253,078, 2,276,322, '323, 2,281,703, 2,311,058 and 2,414,207, Lowe et al U.S. Pat. Nos. 2,484,546, 2,541,474 and 2,632,704, Perry et al U.S. Pat. No. 3,425,836, Smith et al U.S. Pat. Nos. 3,415,653 and 3,615,624, Smith U.S. Pat. No. 3,488,708, Whiteley et al U.S. Pat. Nos. 3,392,025 and 3,511,818, Fitzgerald U.S. Pat. Nos. 3,681,079, 3,721,565, 3,852,073, 3,861,918 and 3,925,083, Fitzgerald et al U.S. Pat. No. 3,879,205, Nottorf U.S. Pat. No. 3,142,568, Houck et al U.S. Pat. Nos. 3,062,674 and 3,220,844, Dann et al U.S. Pat. No. 2,882,161, Schupp U.S. Pat. No. 2,579,016, Weaver U.S. Pat. No. 2,829,053, Alles et al U.S. Pat. No. 2,689,240, Priest et al U.S. Pat. No. 3,003,879, Merrill et al U.S. Pat. No. 3,419,397, Stonham U.S. Pat. No. 3,284,207, Lohmer et al U.S. Pat. No. 3,167,430, Williams U.S. Pat. No. 2,957,767, Dawson et al U.S. Pat. No. 2,893,867, Smith et al U.S. Pat. Nos. 2,860,986 and 2,904,539, Ponticello et al U.S. Pat. Nos. 3,929,482 and 3,860,428, Ponticello U.S. Pat. No. 3,939,130, Dykstra U.S. Pat. No. 3,411,911 and Dykstra et al Canadian Pat. No. 774,054, Ream et al U.S. Pat. No. 3,287,289, Smith U.K. Pat. No. 1,466,600, Stevens U.K. Pat. No. 1,062,116, Fordyce U.S. Pat. No. 2,211,323, Martinez U.S. Pat. No. 2,284,877, Watkins U.S. Pat. No. 2,420,455, Jones U.S. Pat. No. 2,533,166, Bolton U.S. Pat. No. 2,495,918, Graves U.S. Pat. No. 2,289,775, Yackel U.S. Pat. No. 2,565,418, Unruh et al U.S. Pat. Nos. 2,865,893 and 2,875,059, Rees et al U.S. Pat. No. 3,536,491, Broadhead et al U.K. Pat. No. 1,348,815, Taylor et al U.S. Pat. No. 3,479,186, Merrill et al U.S. Pat. No. 3,520,857, Bacon et al U.S. Pat. No. 3,690,888, Bowman U.S. Pat. No. 3,748,143, Dickinson et al U.K. Pat. Nos. 808,227 and '228, Wood U.K. Pat. No. 822,192 and Iguchi et al U.K. Pat. No. 1,398,055. These additional materials need not be present in the reaction vessel during silver halide precipitation, but rather are conventionally added to the emulsion prior to coating. The vehicle materials, including particularly the hydrophilic colloids, as well as the hydrophobic materials useful in combination therewith can be employed not only in the emulsion layers of the radiographic elements of this invention, but also in other layers, such as overcoat layers, interlayers and layers positioned beneath the emulsion layers.

It is specifically contemplated that grain ripening can occur during the preparation of silver halide emulsions according to the present invention, and it is preferred that grain ripening occur within the reaction vessel during at least silver bromoiodide grain formation. Known silver halide solvents are useful in promoting ripening. For example, an excess of bromide ions, when present in the reaction vessel, is known to promote ripening. It is therefore apparent that the bromide salt solution run into the reaction vessel can itself promote ripening. Other ripening agents can also be employed and can be entirely contained within the dispersing medium in the reaction vessel before silver and halide salt addition, or they can be introduced into the reaction vessel along with one or more of the halide salt, silver salt, or peptizer. In still another variant the ripening agent can be introduced independently during halide and silver salt additions. Although ammonia is a known ripening agent, it is not a preferred ripening agent for the silver bromoiodide emulsions of this invention exhibiting the highest realized speed-granularity relationships. The preferred emulsions of the present invention are non-ammoniacal or neutral emulsions.

Among preferred ripening agents are those containing sulfur. Thiocyanate salts can be used, such as alkali metal, most commonly sodium and potassium, and ammonium thiocyanate salts. While any conventional quantity of the thiocyanate salts can be introduced, preferred concentrations are generally from about 0.1 to 20 grams of thiocyanate salt per mole of silver halide. Illustrative prior teachings of employing thiocyanate ripening agents are found in Nietz et al, U.S. Pat. No. 2,222,264, cited above; Lowe et al U.S. Pat. No. 2,448,534 and Illingsworth U.S. Pat. No. 3,320,069; the disclosures of which are here incorporated by reference. Alternatively, conventional thioether ripening agents, such as those disclosed in McBride U.S. Pat. No. 3,271,157, Jones U.S. Pat. No. 3,574,628, and Rosecrants et al U.S. Pat. No. 3,737,313, here incorporated by reference, can be employed.

The thin, intermediate aspect ratio tubular grain emulsions are preferably washed to remove soluble salts. The soluble salts can be removed by decantation, filtration, and/or chill setting and leaching, as illustrated by Craft U.S. Pat. No. 2,316,845 and McFall et al U.S. Pat. No. 3,396,027; by coagulation washing, as illustrated by Hewitson et al U.S. Pat. No. 2,618,556, Yutzy et al U.S. Pat. No. 2,614,928, Yackel U.S. Pat. No. 2,565,418, Hart et al U.S. Pat. No. 3,241,969, Waller et al U.S. Pat. No. 2,489,341, Klinger U.K. Pat. No. 1,305,409 and Dersch et al U.K. Pat. No. 1,167,159; by centrifugation and decantation of a coagulated emulsion, as illustrated by Murray U.S. Pat. No. 2,463,794, Ujihara et al U.S. Pat. No. 3,707,378, Audran U.S. Pat. No. 2,996,287 and Timson U.S. Pat. No. 3,498,454; by employing hydrocyclones alone or in combination with centrifuges, as illustrated by U.K. Pat. No. 1,336,692, Claes U.K. Pat. No. 1,356,573 and Ushomirskii et al

*Soviet Chemical Industry*, Vol. 6, No. 3, 1974, pp. 181–185; by diafiltration with a semipermeable membrane, as illustrated by *Research Disclosure*, Vol. 102, October 1972, Item 10208, Hagemaier et al *Research Disclosure*, Vol. 131, March 1975, Item 13122, Bonnet *Research Disclosure*, Vol. 135, July 1975, Item 13577, Berg et al German OLS No. 2,436,461, Bolton U.S. Pat. No. 2,495,918, and Mignot U.S. Pat. No. 4,334,012, cited above, or by employing an ion exchange resin, as illustrated by Maley U.S. Pat. No. 3,782,953 and Noble U.S. Pat. No. 2,827,428. The emulsions, with or without sensitizers, can be dried and stored prior to use as illustrated by *Research Disclosure*, Vol. 101, September 1972, Item 10152. In the present invention washing is particularly advantageous in terminating ripening of the tabular grains after the completion of precipitation to avoid increasing their thickness and reducing their aspect ratio.

Although the procedures for preparing tabular silver halide grains described above will produce thin, intermediate aspect ratio tabular grain emulsions in which the tabular grains satisfying the thickness criterium for determining average aspect ratio account for at least 50 percent of the total projected area of the total silver halide grain population, it is recognized that further advantages can be realized by increasing the proportion of such thin tabular grains present. Preferably at least 70 percent (optimally at least 90 percent) of the total projected area is provided by tabular silver halide grains. The grains other than those required to satisfy the projected area requirements can be either nontabular or, preferably, high aspect ratio (greater than 8:1) tabular grains, most preferably thin high aspect ratio tabular grains.

b. Sensitization

Although not required to achieve the crossover advantages of this invention, the thin, intermediate aspect ratio tabular grain silver halide emulsions as well as other silver halide emulsions in the radiographic elements of this invention are preferably chemically sensitized. Preferred chemical sensitization of thin, intermediate aspect ratio tabular grain silver halide emulsions is taught by Kofron et al, cited above and here incorporated by reference. They can be chemically sensitized with active gelatin, as illustrated by T. H. James, *The Theory of the Photographic Process*, 4th Ed., Macmillan, 1977, pp. 67–76, or with sulfur, selenium, tellurium, gold, platinum, palladium, iridium, osmium, rhodium, rhenium, or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 120, April 1974, Item 12008, *Research Disclosure*, Vol. 134, June 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Pat. No. 3,297,446, McBride U.K. Pat. No. 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Pat. No. 1,396,696; chemical sensitization being optionally conducted in the presence of thiocyanate compounds, as described in Damschroder U.S. Pat. No. 2,642,361; sulfur containing compounds of the type disclosed in Lowe et al U.S. Pat. No. 2,521,926, Williams et al U.S. Pat. No. 3,021,215, and Bigelow U.S. Pat. No. 4,054,457. It is specifically contemplated to sensitize chemically in the presence of finish (chemical sensitization) modifiers—that is, compounds known to suppress fog and increase speed when present during chemical sensitization, such as azaindenes, azapyridazines, azapyrimidines, benzothiazolium salts, and sensitizers having one or more heterocyclic nuclei. Exemplary finish modifiers are described in Brooker et al U.S. Pat. No. 2,131,038, Dostes U.S. Pat. No. 3,411,914, Kuwabara et al U.S. Pat. No. 3,554,757, Oguchi et al U.S. Pat. No. 3,565,631, Oftedahl U.S. Pat. No. 3,901,714, Walworth Canadian Pat. No. 778,723, and Duffin *Photographic Emulsion Chemistry*, Focal Press (1966), New York, pp. 138–143. Additionally or alternatively, the emulsions can be reduction sensitized—e.g., with hydrogen, as illustrated by Janusonis U.S. Pat. No. 3,891,446 and Babcock et al U.S. Pat. No. 3,984,249, by low pAg (e.g., less than 5) and/or high pH (e.g., greater than 8) treatment or through the use of reducing agents, such as stannous chloride, thiourea dioxide, polyamines and amineboranes, as illustrated by Allen et al U.S. Pat. No. 2,983,609. Oftedahl et al *Research Disclosure*, Vol. 136, August 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564. Surface chemical sensitization, including sub-surface sensitization, illustrated by Morgan U.S. Pat. No. 3,917,485 and Becker U.S. Pat. No. 3,966,476, is specifically contemplated.

The thin, intermediate aspect ratio tabular grain silver halide emulsions are in all instances spectrally sensitized. It is specifically contemplated to employ in combination with the thin, intermediate aspect ratio tabular grain emulsions and other emulsions disclosed herein spectral sensitizing dyes that exhibit absorption maxima in the blue and minus blue—i.e., green and red, portions of the visible spectrum. In addition, for specialized applications, spectral sensitizing dyes can be employed which improve spectral response beyond the visible spectrum. For example, the use of infrared absorbing spectral sensitizers is specifically contemplated.

The thin, intermediate aspect ratio tabular grain silver halide emulsions can be spectrally sensitized with dyes from a variety of classes, including the polymethine dye class, which classes include the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, oxazolinium, thiazolium, thiazolinium, selenazolium, selenazolinium, imidazolium, imidazolinium, benzoxazolium, benzothiazolium, benzoselenazolium, benzimidazolium, naphthoxazolium, naphthothiazolium, naphthoselenazolium, dihydronaphthothiazolium, pyrylium and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depend upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as compounds which can be responsible for supersensitization are discussed by Gilman, "Review of the Mechanisms of Supersensitization", *Photographic Science and Engineering,* Vol. 18, 1974, pp. 418–430.

Spectral sensitizing dyes also affect the emulsions in other ways. Spectral sensitizing dyes can also function as antifoggants or stabilizers, development accelerators or inhibitors, and halogen acceptors or electron acceptors, as disclosed in Brooker et al U.S. Pat. No. 2,131,038 and Shiba et al U.S. Pat. No. 3,930,860.

In a preferred form of this invention the tabular silver halide grains have adsorbed to their surfaces spectral sensitizing dye which exhibits a shift in hue as a function of adsorption. Any conventional spectral sensitizing dye known to exhibit a bathochromic or hypsochromic increase in light absorption as a function of adsorption to the surface of silver halide grains can be employed in the practice of this invention. Dyes satisfying such criteria are well known in the art, as illustrated by T. H. James, *The Theory of the Photographic Process*, 4th Ed., Macmillan, 1977, Chapter 8 (particularly, F. Induced Color Shifts in Cyanine and Merocyanine Dyes) and Chapter 9 (particularly, H. Relations Between Dye Structure and Surface Aggregation) and F. M. Hamer, *Cyanine Dyes and Related Compounds*, John Wiley and Sons, 1964, Chapter XVII (particularly, F. Polymerization and Sensitization of the Second Type). Merocyanine, hemicyanine, styryl, and oxonol spectral sensitizing dyes which produce H aggregates (hypsochromic shifting) are known to the art, although J aggregates (bathochromic shifting) is not common for dyes of these classes. Preferred spectral sensitizing dyes are cyanine dyes which exhibit either H or J aggregation.

In a specifically preferred form the spectral sensitizing dyes are carbocyanine dyes which exhibit J aggregation. Such dyes are characterized by two or more basic heterocyclic nuclei joined by a linkage of three methine groups. The heterocyclic nuclei preferably include fused benzene rings to enhance J aggregation. Preferred heterocyclic nuclei for promoting J aggregation are quinolinium, benzoxazolium, benzothiazolium, benzoselenazolium, benzimidazolium, naphthooxazolium, naphthothiazolium, and naphthoselenazolium quaternary salts.

Sensitizing action can be correlated to the position of molecular energy levels of a dye with respect to ground state and conduction band energy levels of the silver halide crystals. These energy levels can in turn be correlated to polarographic oxidation and reduction potentials, as discussed in *Photographic Science and Engineering*, Vol. 18, 1974, pp. 49–53 (Sturmer et al), pp. 175–178 (Leubner) and pp. 475–485 (Gilman). Oxidation and reduction potentials can be measured as described by R. J. Cox, *Photographic Sensitivity,* Academic Press, 1973, Chapter 15.

The chemistry of cyanine and related dyes is illustrated by Weissberger and Taylor, *Special Topics of Heterocyclic Chemistry,* John Wiley and Sons, New York, 1977, Chapter VIII; Venkataraman, *The Chemistry of Synthetic Dyes*, Academic Press, New York, 1971, Chapter V; James, *The Theory of the Photographic Process*, 4th Ed., Macmillan, 1977, Chapter 8, and F. M. Hamer, *Cyanine Dyes and Related Compounds,* John Wiley and Sons, 1964.

Although native blue sensitivity of silver bromide or bromoiodide is usually relied upon in the art in emulsion layers intended to record exposure to blue light, significant advantages can be obtained by the use of spectral sensitizers, even where their principal absorption is in the spectral region to which the emulsions possess native sensitivity. For example, it is specifically recognized that advantages can be realized from the use of blue spectral sensitizing dyes.

Useful blue spectral sensitizing dyes for thin, intermediate aspect ratio tabular grain silver bromide and silver bromoiodide emulsions can be selected from any of the dye classes known to yield spectral sensitizers. Polymethine dyes, such as cyanines, merocyanines, hemicyanines, hemioxonols, and merostyryls, are preferred blue spectral sensitizers. Generally useful blue spectral sensitizers can be selected from among these dye classes by their absorption characteristics—i.e., hue. There are, however, general structural correlations that can serve as a guide in selecting useful blue sensitizers. Generally the shorter the methine chain, the shorter the wavelength of the sensitizing maximum. Nuclei also influence absorption. The addition of fused rings to nuclei tends to favor longer wavelengths of absorption. Substituents can also alter absorption characteristics.

Among useful spectral sensitizing dyes for sensitizing silver halide emulsions are those found in U.K. Pat. No. 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,231,658, 2,493,747, '748, 2,526,632, 2,739,964 (Re. 24,292), 2,778,823, 2,917,516, 3,352,857, 3,411,916 and 3,431,111, Wilmanns et al U.S. Pat. No. 2,295,276, Sprague U.S. Pat. Nos. 2,481,698 and 2,503,776, Carroll et al U.S. Pat. Nos. 2,688,545 and 2,704,714, Larive et al U.S. Pat. No. 2,921,067, Jones U.S. Pat. No. 2,945,763, Nys et al U.S. Pat. No. 3,282,933, Schwan et al U.S. Pat. No. 3,397,060, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349. Examples of useful dye combinations, including supersensitizing dye combinations, are found in Motter U.S. Pat. No. 3,506,443 and Schwan et al U.S. Pat. No. 3,672,898. As examples of supersensitizing combinations of spectral sensitizing dyes and nonlight absorbing addenda, it is specifically contemplated to employ thiocyanates during spectral sensitization, as taught by Leermakers U.S. Pat. No. 2,221,805; bis-triazinylaminostilbenes, as taught by McFall et al U.S. Pat. No. 2,933,390; sulfonated aromatic compounds, as taught by Jones et al U.S. Pat. No. 2,937,089; mercapto-substituted heterocycles, as taught by Riester U.S. Pat. No. 3,457,078; iodide, as taught by U.K. Pat. No. 1,413,826; and still other compounds, such as those disclosed by Gilman, "Review of the Mechanisms of Supersensitization", cited above.

Conventional amounts of dyes can be employed in spectrally sensitizing the emulsion layers containing nontabular or low aspect ratio tabular silver halide grains. To realize the full advantages of this invention it is preferred to adsorb spectral sensitizing dye to the grain surfaces of the thin, intermediate aspect ratio tabular grain emulsions in a substantially optimum amount—that is, in an amount sufficient to realize at least 60 percent of the maximum photographic speed attainable from the grains under contemplated conditions of exposure. The quantity of dye employed will vary with the specific dye or dye combination chosen as well as the size and aspect ratio of the grains. It is known in the photographic art that optimum spectral sensitization is obtained with organic dyes at about 25 to 100 percent or more of monolayer coverage of the total available surface area of surface sensitive silver halide grains, as disclosed, for example, in West et al, "The Adsorption of Sensitizing Dyes in Photographic Emulsions", *Journal of Phys. Chem.*, Vol. 56, p. 1065, 1952; Spence et al, "Desensitization of Sensitizing Dyes", *Journal of Physical and Colloid Chemistry*, Vol. 56, No. 6, June 1948, pp. 1090–1103; and Gilman et al U.S. Pat. No. 3,979,213. Optimum dye concentration levels can be chosen by procedures taught by Mees, *Theory of the Photographic Process*, 1942, Macmillan, pp. 1067–1069.

Spectral sensitization can be undertaken at any stage of emulsion preparation heretofore known to be useful. Most commonly spectral sensitization is undertaken in the art subsequent to the completion of chemical sensitization. However, it is specifically recognized that spectral sensitization can be undertaken alternatively concurrently with chemical sensitization, can entirely precede chemical sensitization, and can even commence prior to the completion of silver halide grain precipitation, as taught by Philippaerts et al U.S. Pat. No. 3,628,960, and Locker et al U.S. Pat. No. 4,225,666. As taught by Locker et al, it is specifically contemplated to distribute introduction of the spectral sensitizing dye into the emulsion so that a portion of the spectral sensitizing dye is present prior to chemical sensitization and a remaining portion is introduced after chemical sensitization. Unlike Locker et al, it is specifically contemplated that the spectral sensitizing dye can be added to the emulsion after 80 percent of the silver halide has been precipitated. Sensitization can be enhanced by pAg adjustment, including cycling, during chemical and/or spectral sensitization. A specific example of pAg adjustment is provided by *Research Disclosure*, Vol. 181, May 1979, Item 18155.

In one preferred form, spectral sensitizers can be incorporated in the emulsions of the present invention prior to chemical sensitization. Similar results have also been achieved in some instances by introducing other adsorbable materials, such as finish modifiers, into the emulsions prior to chemical sensitization.

Independent of the prior incorporation of adsorbable materials, it is preferred to employ thiocyanates during chemical sensitization in concentrations of from about $2\times10^{-3}$ to 2 mole percent, based on silver, as taught by Damschroder U.S. Pat. No. 2,642,361, cited above. Other ripening agents can be used during chemical sensitization.

In still a third approach, which can be practiced in combination with one or both of the above approaches or separately thereof, it is preferred to adjust the concentration of silver and/or halide salts present immediately prior to or during chemical sensitization. Soluble silver salts, such as silver acetate, silver trifluoroacetate, and silver nitrate, can be introduced as well as silver salts capable of precipitating onto the grain surfaces, such as silver thiocyanate, silver phosphate, silver carbonate, and the like. Fine silver halide (i.e., silver bromide, iodide, and/or chloride) grains capable of Ostwald ripening onto the tabular grain surfaces can be introduced. For example, a Lippmann emulsion can be introduced during chemical sensitization. Maskasky U.S. Ser. No. 320,920, cited above and here incorporated by reference, discloses the chemical sensitization of spectrally sensitized high aspect ratio tabular grain emulsions at one or more ordered discrete sites of the tabular grains. It is believed that the preferential adsorption of spectral sensitizing dye on the crystallographic surfaces forming the major faces of the tabular grains allows chemical sensitization to occur selectively at unlike crystallographic surfaces of the tabular grains.

The preferred chemical sensitizers for the highest attained speed-granularity relationships are gold and sulfur sensitizers, gold and selenium sensitizers, and gold, sulfur, and selenium sensitizers. Thus, in a preferred form of the invention, thin, intermediate aspect ratio tabular grain silver bromide or, most preferably, silver bromoiodide emulsions contain a middle chalcogen, such as sulfur and/or selenium, which may not be detectable, and gold, which is detectable. The emulsions also usually contain detectable levels of thiocyanate, although the concentration of the thiocyanate in the final emulsions can be greatly reduced by known emulsion washing techniques. In various of the preferred forms indicated above the tabular silver bromide or silver bromoiodide grains can have another silver salt at their surface, such as silver thiocyanate, or another silver halide of differing halide content (e.g., silver chloride or silver bromide), although the other silver salt may be present below detectable levels.

Although not required to realize all of their advantages, the emulsions employed in the present invention are preferably, in accordance with prevailing manufacturing practices, substantially optimally chemically as well as being substantially optimally spectrally sensitized. That is, they preferably achieve speeds of at least 60 percent of the maximum log speed attainable from the grains in the spectral region of sensitization under the contemplated conditions of use and processing. Log speed is herein defined as 100 (1-log E), where E is measured in meter-candle-seconds at a density of 0.1 above fog. Once the silver halide grains of an emulsion have been characterized, it is possible to estimate from further product analysis and performance evaluation whether an emulsion layer of a product appears to be substantially optimally chemically and spectrally sensitized in relation to comparable commercial offerings of other manufacturers.

c. Completion of the radiographic element

Once thin, intermediate aspect ratio tabular grain emulsions have been generated by precipitation procedures, washed, and sensitized, as described above, their preparation can be completed by the incorporation of conventional photographic addenda.

Dickerson, cited above and here incorporated by reference, discloses that hardening radiographic elements according to the present invention intended to form silver images to an extent sufficient to obviate the necessity of incorporating additional hardener during processing permits increased silver covering power to be realized as compared to radiographic elements similarly hardened and processed, but employing nontabular or conventional, thick tabular grain emulsions. Specifically, it is taught to harden the thin tabular grain emulsion layers and other hydrophilic colloid layers of radiographic elements in an amount sufficient to reduce swelling of the layers to less than 200 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) measuring change in layer thickness. Although hardening of the radiographic elements intended to form silver images to the extent that hardeners need not be incorporated in processing solutions is specifically preferred, it is recognized that the emulsions of the present invention can be hardened to any conventional level. It is further specifically contemplated to incorporate hardeners in processing solutions, as illustrated, for example, by *Research Disclosure,* Vol. 184, August 1979, Item 18431, Paragraph K, relating particularly to the processing of radiographic materials.

Typical useful incorporated hardeners (forehardeners) include formaldehyde and free dialdehydes, such as succinaldehyde and glutaraldehyde, as illustrated by Allen et al U.S. Pat. No. 3,232,764; blocked dialdehydes, as illustrated by Kaszuba U.S. Pat. No. 2,586,168, Jeffreys U.S. Pat. No. 2,870,013, and Yamamoto et al U.S. Pat. No. 3,819,608; α-diketones, as illustrated by Allen et al U.S. Pat. No. 2,725,305; active esters of the type described by Burness et al U.S. Pat. No. 3,542,558; sulfonate esters, as illustrated by Allen et al U.S. Pat. Nos. 2,725,305 and 2,726,162; active halogen compounds, as illustrated by Burness U.S. Pat. No. 3,106,468, Silverman et al U.S. Pat. No. 3,839,042, Ballantine et al U.S. Pat. No. 3,951,940 and Himmelmann et al U.S. Pat. No. 3,174,861; s-triazines and diazines, as illustrated by Yamamoto et al U.S. Pat. No. 3,325,287, Anderau et al U.S. Pat. No. 3,288,775 and Stauner et al U.S. Pat. No. 3,992,366; epoxides, as illustrated by Allen et al U.S. Pat. No. 3,047,394, Burness U.S. Pat. No. 3,189,459 and Birr et al German Pat. No. 1,085,663; aziridines, as illustrated by Allen et al U.S. Pat. No. 2,950,197, Burness et al U.S. Pat. No. 3,271,175 and Sato et al U.S. Pat. No. 3,575,705; active olefins having two or more active vinyl groups (e.g. vinylsulfonyl groups), as illustrated by Burness et al U.S. Pat. Nos. 3,490,911, 3,539,644 and 3,841,872 (Re. 29,305), Cohen U.S. Pat. No. 3,640,720, Kleist et al German Pat. No. 872,153 and Allen U.S. Pat. No. 2,992,109; blocked active olefins, as illustrated by Burness et al U.S. Pat. No. 3,360,372 and Wilson U.S. Pat. No. 3,345,177; carbodiimides, as illustrated by Blout et al German Pat. No. 1,148,446; isoxazolium salts unsubstituted in the 3-position, as illustrated by Burness et al U.S. Pat. No. 3,321,313; esters of 2-alkoxy-N-carboxydihydroquinoline, as illustrated by Bergthaller et al U.S. Pat. No. 4,013,468; N-carbamoyl and N-carbamoyloxypyridinium salts, as illustrated by Himmelmann U.S. Pat. No. 3,880,665; hardeners of mixed function, such as halogen-substituted aldehyde acids (e.g., mucochloric and mucobromic acids), as illustrated by White U.S. Pat. No. 2,080,019, 'onium substituted acroleins, as illustrated by Tschopp et al U.S. Pat. No. 3,792,021, and vinyl sulfones containing other hardening functional groups, as illustrated by Sera et al U.S. Pat. No. 4,028,320; and polymeric hardeners, such as dialdehyde starches, as illustrated by Jeffreys et al U.S. Pat. No. 3,057,723, and copoly(acrolein-methacrylic acid), as illustrated by Himmelmann et al U.S. Pat. No. 3,396,029.

The use of forehardeners in combination is illustrated by Sieg et al U.S. Pat. No. 3,497,358, Dallon et al U.S. Pat. Nos. 3,832,181 and 3,840,370 and Yamamoto et al U.S. Pat. No. 3,898,089. Hardening accelerators can be used, as illustrated by Sheppard et al U.S. Pat. No. 2,165,421, Kleist German Pat. No. 881,444, Riebel et al U.S. Pat. No. 3,628,961 and Ugi et al U.S. Pat. No. 3,901,708. The patents illustrative of hardeners and hardener combinations are here incorporated by reference.

In addition to the features specifically described above the radiographic elements of this invention can include additional features of a conventional nature in radiographic elements. Exemplary features of this type are disclosed, for example, in *Research Disclosure,* Item 18431, cited above and here incorporated by reference. For example, the emulsions can contain stabilizers, antifoggants, and antikink agents, as set forth in Paragraph II, A through K. The radiographic element can contain antistatic agents and/or layers, as set forth in Paragraph III. The radiographic elements can contain overcoat layers, as set out in Paragraph IV. The overcoat layers can contain matting agents disclosed in *Research Disclosure,* Item 17643, cited above, Paragraph VI. The overcoat and other layers of the radiographic elements can contain plasticizers and lubricants, such as those disclosed in Item 17643, Paragraph XII. Although the radiographic elements of this invention will in most applications be used to form silver images, color materials, such as those disclosed in Item 17643, Paragraph VII, can be incorporated to permit the formation of dye or dye-enhanced silver images. Developing agents and development modifiers, such as those set forth in Item 17643, Paragraphs XX and XXI can be optionally incorporated. The crossover advantages of the present invention can be further improved by employing conventional crossover exposure control approaches, as disclosed in Item 18431, Paragraph V.

In accordance with established practices within the art it is specifically contemplated to blend the thin, intermediate aspect ratio tabular grain emulsions with each other or with conventional emulsions to satisfy specific emulsion layer requirements. For example, it is known to blend emulsions to adjust the characteristic curve of a photographic element to satisfy a predetermined aim. Blending can be employed to increase or decrease maximum densities realized on exposure and processing, to decrease or increase minimum density, and to adjust characteristic curve shape intermediate its toe and shoulder. To accomplish this the thin, intermediate aspect ratio tubular grain emulsions can be blended with conventional silver halide emulsions, such as those described in Item 17643, cited above, Paragraph I or any of the high aspect ratio tabular grain emulsions, such as those of Wilgus and Haefner, Maskasky, or Wilgus and Wey, cited above. It is specifically contemplated to blend the emulsions as described in sub-paragraph F of Paragraph I. When a relatively fine grain silver chloride emulsion is blended with the emulsions of the present invention, particularly the silver bromoiodide emulsions, a further increase in the sensitivity—i.e., speed-granularity relationship—of the emulsion can result.

The supports can be of any conventional type known to permit crossover. Preferred supports are polyester film suports. Poly(ethylene terephthalate) film supports are specifically preferred. Such supports as well as their preparation are disclosed in Scarlett U.S. Pat. No. 2,823,421, Alles U.S. Pat. No. 2,779,684, and Arvidson and Stottlemyer U.S. Pat. No. 3,939,000. Medical radiographic elements are usually blue tinted. Generally the tinting dyes are added directly to the molten polyester prior to extrusion and therefore must be thermally stable. Preferred tinting dyes are anthraquinone dyes, such as those disclosed by Hunter U.S. Pat. No. 3,488,195, Hibino et al U.S. Pat. No. 3,849,139, Arai et al U.S. Pat. Nos. 3,918,976 and 3,933,502, Okuyama et al U.S. Pat. Nos. 3,948,664, and U.K. Pat. Nos. 1,250,983 and 1,372,668.

The spectral sensitizing dyes are chosen to exhibit an absorption peak in their adsorbed state, usually, in their aggregated form, in the H or J band, in a region of the spectrum corresponding to the wavelength of electromagnetic radiation to which the element is being imagewise exposed. The electromagnetic radiation producing imagewise exposure is emitted from phosphors of intensifying screens. A separate intensifying screen exposes each of the two imaging units located on opposite sides of the support. The intensifyng screens can emit light in the ultraviolet, blue, green, or red portions of the spectrum, depending upon the specific phosphors chosen for incorporation therein. It is common for the intensifying screens to emit light in the green (500 to 600 nm) region of the spectrum. Therefore, the preferred spectral sensitizing dyes for use in the practice of this invention are those which exhibit an absorption peak in the green portion of the spectrum. In a specifically preferred form of the invention the spectral sensitizing dye is a carbocyanine dye exhibiting a J band absorption when adsorbed to the tabular grains in a spectral region corresponding to peak emission by the intensifying screen, usually the green region of the spectrum.

The intensifying screens can themselves form a part of the radiographic elements, but usually they are separate elements which are reused to provide exposures of successive radiographic elements. Intensifying screens are well known in the radiographic art. Conventional intensifying screens and their components are disclosed by *Research Disclosure,* Vol. 18431, cited above, Paragraph IX, and by Rosecrants U.S. Pat. No. 3,737,313, the disclosures of which are here incorporated by reference.

The exposed radiographic elements can be processed by any convenient conventional technique. Such processing techniques are illustrated by *Research Disclosure,* Item 17643, cited above, Paragraph XIX. Roller transport processing is particularly preferred, as illustrated by Russel et al U.S. Pat. Nos. 3,025,779 and 3,515,556, Barnes et al U.S. Pat. No. 3,545,971, L Taber et al U.S. Pat. No. 3,647,459, and Rees et al U.K. Pat. No. 1,269,268. Hardening development can be undertaken, as illustrated by Allen et al U.S. Pat. No. 3,232,761. Either the developers or the radiographic elements can contain adducts of thioamine and glutaraldehyde or acrylic aldehyde, as illustrated by Amering U.S. Pat. No. 3,869,289 and Plakunov et al U.S. Pat. No. 3,708,302.

EXAMPLES

The invention can be better appreciated by reference to the following illustrative examples.

In each of the examples the contents of the reaction vessel were stirred vigorously throughout silver and halide salt introductions. All solutions, unless otherwise indicated are aqueous solutions.

Examples 1 and 2

Control Emulsion A

Control Emulsion A was a 0.4 μm diameter octahedral AgBr emulsion prepared by a conventional double-jet precipitation technique at controlled pAg 8.3 at 75° C.

Tabular Grain Emulsion 1

To 6.0 liters of a well-stirred aqueous bone gelatin (0.75 percent by weight) solution at 55° C. which contained 0.143 molar potassium bromide was added a 1.0 molar $AgNO_3$ solution at constant flow for 4 minutes consuming 1.8 percent of the total silver used. the $AgNO_3$ solution was next added by accelerated flow (5.75× from start to finish) for an additional 4 minutes consuming 6.6 percent of the total silver used. Then 850 ml. of a phthalated gelatin (15.3 percent by weight) solution were added. A 2.3 molar NaBr solution and a 2.0 molar $AgNO_3$ solution were added at controlled pBr ~1.47 at 55° C. by double-jet addition by accelerated flow (5× from start to finish) for 26 minutes consuming 35.6 percent of the total silver used. Then the NaBr solution was halted and the $AgNO_3$ solution continued at a constant flow rate until pAg 8.35 at 55° C. was reached consuming 3.4 percent of the total silver used. An additional 850 ml. of a phthalated gelatin (15.3 percent by weight) solution were added. Then a 2.3 molar NaBr solution and a 2.0 molar $AgNO_3$ solution were added by double-jet addition at constant flow for 58 minutes at controlled pAg 8.35 at 55° C. consuming 52.5 percent of the total silver used. Approximately 8.8 moles of silver were used to prepare this emulsion. Following precipitation the emulsion was cooled to 40° C., washed two times by the coagulation process of Yutzy and Frame U.S. Pat. No. 2,614,928. Then 1.6 liters of a bone gelatin (16.8 percent by weight) solution were added and the emulsion was adjusted to pH 5.5 and pAg 8.3 at 40° C.

The resultant tabular grain AgBr emulsion had an average grain diameter of 0.73 μm, an average thickness of 0.09 μm, and an average aspect ratio of ~7.9:1, and greater than 75 percent of the projected area was contributed by thin, intermediate aspect ratio tabular grains (thickness <0.30 μm and aspect ratio >5:1).

Tabular Grain Emulsion 2

Tabular grain emulsion 2 was prepared similar to emulsion 1 above except that for the double-jet addition of the NaBr and $AgNO_3$ solutions at pBr 1.47 at 55° C.

the accelerated flow profile was from 3.75× from start to finish and the run time was reduced from 26 minutes to 17 minutes consuming 21.5 percent of the total silver used. A total of 7.25 moles of silver were used to prepare this emulsion.

The resultant tabular grain AgBr emulsion had an average grain diameter of 0.64 μm, an average thickness of 0.10 μm, and an average aspect ratio of 6.5:1, and greater than 70 percent of the projected area was contributed by thin, intermediate aspect ratio tabular grains (thickness <0.30 μm and aspect ratio >5:1).

Sensitization and Coating

Control Emulsion A and tabular grain emulsions 1 and 2 were chemically sensitized with 5 mg. potassium tetrachloroaurate/Ag mole, 10 mg. sodium thiosulfate pentahydrate/Ag mole, and 150 mg. sodium thiocyanate/Ag mole, held for 45 minutes at 70° C., and then spectrally sensitized with 600 mg. anhydro-5,5'-dichloro-9-ethyl-3,3'-di(3-sulfopropyl)oxacarbocyanine hydroxide, sodium salt/Ag mole and 400 mg. potassium iodide/Ag mole.

The control and tabular grain emulsions were coated on both sides of a poly(ethylene terephthalate) film support. Each side contained an emulsion layer of 21.5 mg. silver/dm$^2$ and 28.7 mg. gelatin/dm$^2$ with an 8.8 mg. gelatin/dm$^2$ overcoat. The emulsions were forehardened with 0.5% by weight bis(vinylsulfonylmethyl)ether based on the total weight of gelatin.

Crossover and Speed Comparisons

The coatings were exposed to radiation from a Picker Corp. single-phase X-ray generator operating a Machlett Dymax Type 59B X-ray tube. Exposure times were 1 second using a tube current of 100 ma and a tube potential of 70 kilovolts. Following exposure the radiographic elements were processed in a conventional radiographic element processor, commercially available under the trademark Kodak RP X-Omat Film Processor M6A-N, using the standard developer for this processor, commercially available under the trademark MX-810 developer. Development time was 21 seconds at 35° C.

The crossover comparisons of the coatings were obtained from a sensitometric exposure utilizing one intensifying screen adjacent to the film. Emission from the single screen produced a primary sensitometric curve attributable to the emulsion layer adjacent the intensifying screen and a secondary, slower curve attributable to the emulsion layer separated by the film support from the intensifying screen. The emulsion layer farthest from the exposing screen was exposed entirely by radiation which had penetrated the nearest emulsion layer and the film support. Thus, the farthest emulsion layer from the screen was exposed entirely by radiation which had "crossed over". The average displacement (expressed as Δ log E) between the intermediate portions of the characteristic curves (density vs. log E plots, where E is exposure in meter-candle-seconds) was used to calculate percent crossover for the separate coatings using the following equation:

$$\text{Percent Crossover} = \frac{1}{\text{antilog}\,(\Delta \log E) + 1} \times 100$$

The crossover and sensitometric results of the coatings of the control and tabular grain emulsions are reported in Table I

TABLE I

| Emulsion No. | Grain Diameter | Thickness | Aspect Ratio | Crossover Percent | Relative Speed* |
|---|---|---|---|---|---|
| Control A | 0.4 μm | 0.4 μm | 1:1 | 17.0 | 100 |
| Tabular 1 | 0.73 μm | ~0.09 μm | 7.9:1 | 18.0 | 205 |
| Tabular 2 | 0.64 μm | ~0.10 μm | 6.5:1 | 17.5 | 199 |

*30 relative speed units = 0.30 log E

The data in Table I illustrate the photographic advantage of the thin, intermediate aspect ratio tabular grain silver halide emulsions when coated on both sides of a support and tested in an X-ray format. Control emulsion A had a grain volume of 0.030(μm)$^3$ and tabular grain emulsion 2 had a grain volume of 0.032(μm)$^3$. Although both emulsions demonstrated comparable crossover results at near equivalent grain volumes, the tabular grain emulsion was significantly faster in speed (~1.0 Log E). Likewise tabular grain emulsion 1, 0.038(μm)$^3$ grain volume, had similar crossover to the control emulsion A and was 1.05 Log E faster in speed.

The invention has been described in detail with particular reference to preferred embodiments thereof, but it will be understood that variations and modifications can be effected within the spirit and scope of the invention.

What is claimed is:

1. In a radiographic element comprised of
first and second imaging means,
at least said first imaging means including a silver halide emulsion comprised of a dispersing medium and radiation-sensitive silver halide grains, and
a support interposed between said imaging means capable of transmitting radiation to which said second imaging means is responsive
the improvement comprising said first imaging means containing
tabular silver halide grains having a thickness of less than 0.2 micron and an average aspect ratio of from 5:1 to 8:1 accounting for at least 50 percent of the total projected area of said silver halide grains present in said silver halide emulsion and
spectral sensitizing dye adsorbed to the surface of said tabular silver halide grains in an amount sufficient to substantially optimally sensitize said tabular grains.

2. An improved radiographic element according to claim 1 wherein said support is a film support.

3. An improved radiographic element according to claim 1 wherein said support is a blue tinted transparent film support.

4. An improved radiographic element according to claim 1 wherein said tabular silver halide grains account for at least 70 percent of the total projected area of said silver halide grains.

5. An improved radiographic element according to claim 1 wherein said dispersing medium is comprised of a hardenable hydrophilic colloid.

6. An improved radiographic element according to claim 1 wherein said silver halide is silver bromide or silver bromoiodide.

7. An improved radiographic element according to claim 1 wherein said spectral sensitizing dye exhibits a shift in hue as a function of adsorption.

8. An improved radiographic element according to claim 7 wherein said spectral sensitizing dye is a cyanine dye.

9. In a radiographic element comprised of first and second silver halide emulsion layers each comprised of a dispersing medium and radiation-sensitive silver bromide or silver bromoiodide grains and a film support interposed between said emulsion layers capable of transmitting radiation to which said emulsion layers are responsive, the improvement comprising said emulsion layer containing substantially optimally chemically sensitized tabular silver bromide or silver bromoiodide grains having a thickness of less than 0.2 micron and an average aspect ratio from 5:1 to 8:1 accounting for at least 70 percent of the total projected area of said silver bromide or silver bromoiodide grains present in said silver halide emulsion layer and spectral sensitizing dye which exhibits a shift in hue as a function of adsorption being adsorbed to the surface of said tabular silver bromide or silver bromoiodide grains in an amount sufficient to substantially optimally sensitize said tabular grains.

10. An improved radiographic element according to claim 9 wherein said dispersing medium is gelatin or a gelatin derivative.

11. An improved radiographic element according to claim 9 wherein said sensitizing dye is a cyanine dye exhibiting a bathochromic shift in hue as a function of adsorption.

12. An improved radiographic element according to claim 11 wherein said cyanine dye contains at least one nucleus chosen from the group consisting of quinolinium, benzoxazolium, benzothiazolium, benzoselenazolium, benzimidazolium, naphthoxazolium, naphthothiazolium, and naphthoselenazolium nuclei.

13. An improved radiographic element according to claim 12 wherein said cyanine dye is a carbocyanine dye.

14. An improved radiographic element according to claim 9 wherein said sensitizing dye is present in a concentration of from about 25 to 100 mole percent of monolayer coverage of the surface of said silver bromide or bromoiodide grains.

15. An improved radiographic element according to claim 9 wherein said spectral sensitizing dye is a green spectral sensitizing dye.

* * * * *

REEXAMINATION CERTIFICATE (907th)

United States Patent [19]

Abbott et al.

[11] B1 4,425,426

[45] Certificate Issued Aug. 9, 1988

[54] RADIOGRAPHIC ELEMENTS EXHIBITING REDUCED CROSSOVER

[75] Inventors: Thomas I. Abbott, Rochester; Cynthia G. Jones, Bergen, both of N.Y.

[73] Assignee: Eastman Kodak Company, Rochester, N.Y.

Reexamination Request:
No. 90/001,255, Jun. 8, 1987

Reexamination Certificate for:

| | |
|---|---|
| Patent No.: | **4,425,426** |
| Issued: | **Jan. 10, 1984** |
| Appl. No.: | **431,910** |
| Filed: | **Sep. 30, 1982** |

[51] Int. Cl.[4] ..... G03C 1/76

[52] U.S. Cl. ..... 430/502; 430/139; 430/567; 430/569; 430/570; 430/966

[58] Field of Search ..... 430/966, 139, 502, 567, 430/569, 570

[56] References Cited

U.S. PATENT DOCUMENTS

| | | | |
|---|---|---|---|
| 3,320,069 | 5/1967 | Illingsworth | 430/603 |
| 4,130,428 | 12/1978 | VanDoorselaer | 430/139 |
| 4,172,730 | 10/1979 | Hinata | 96/82 |
| 4,439,520 | 3/1984 | Kofron et al. | 430/434 |

OTHER PUBLICATIONS

*Research Disclosure*, vol. 184, Item No. 18431, p. 433, Radiographic Films/Materials, published Aug. 10, 1979.

Leubner: "Quantitative Correlations Between Sensitization by Dyes and Their Redox Potentials", by Leubner, *Photographic Science and Engineering*, vol. 20, No. 2, pp. 61–68 (1976).

Berriman: "Crystal Growth During the Formation of a Silver-Bromide Dispersion in Gelatin" by Berriman, *The Journal of Photographic Science*, vol. 12, pp. 121–133 (1964).

Hamilton: "The Photographic Grain" by Hamilton, *Applied Optics*, vol. 11, pp. 13–21 (1972).

West: "The Adsorption of Sensitizing Dyes in Photographic Emulsions" by West, Carroll and Whitcomb, *J. Phys. Chem.*, vol. 56, pp. 1054–1067 (1952).

Mees: Chapter 2, "The Silver Halide Grains" by Berry and Loveland, *The Theory of the Photographic Process*, Third Edition, Mees and James, Editors, pp. 31–44, (1966).

James: *Fundamentals of Photographic Theory* by James and Higgins, pp. 21–23, (1960).

Berry: "Effects of Environment on the Growth of Silver Bromide Microcrystals", by Berry, Marino and Oster, *Photographic Science and Engineering*, vol. 5, No. 6, pp. 332–336 (Nov.–Dec. 1961).

*Primary Examiner*—Won H. Louie

[57] ABSTRACT

Radiographic elements are disclosed comprised of first and second imaging portions separated by an interposed support capable of transmitting radiation to which the second imaging portion is responsive. At least the first imaging portion includes a silver halide emulsion in which thin tabular silver halide grains of intermediate aspect ratios are present. Spectral sensitizing dye is adsorbed to the surface of the tabular grains. Crossover can be improved in relation to the imaging characteristics.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-15 is confirmed.

* * * * *